United States Patent [19]

Stagg, Jr.

[11] Patent Number: 4,545,578

[45] Date of Patent: Oct. 8, 1985

[54] DEVICE FOR RANDOMLY SELECTING NUMBERS

[75] Inventor: George A. Stagg, Jr., Wayne, N.J.

[73] Assignee: Pentad Corp., Fairfield, N.J.

[21] Appl. No.: 544,751

[22] Filed: Oct. 24, 1983

[51] Int. Cl.[4] ..... A63F 3/06; A63F 7/04

[52] U.S. Cl. ..... 273/144 B; 273/145 C

[58] Field of Search ..... 273/144 B, 146, 141 R, 273/138 R, 145 R, 145 C, 145 CA

[56] References Cited

U.S. PATENT DOCUMENTS

| | | | |
|---|---|---|---|
| D. 140,075 | 1/1945 | Arehart | D34/5 |
| D. 151,231 | 10/1948 | Funderburg | D34/5 |
| 465,739 | 12/1891 | Guericke | 273/144 B |
| 479,432 | 7/1892 | Lathrop . | |
| 570,858 | 11/1896 | Waddel . | |
| 1,277,263 | 8/1918 | Sato . | |
| 2,969,237 | 10/1959 | Rogers | 273/113 |
| 3,423,093 | 1/1969 | Lahav | 273/141 R X |
| 3,484,108 | 12/1969 | Geiger | 273/146 X |
| 4,114,290 | 9/1978 | Cooper | 273/145 CA |
| 4,368,887 | 1/1983 | Gamble | 273/144 B |
| 4,403,775 | 9/1983 | Chaput | 273/144 B |
| 4,444,394 | 4/1984 | Pasquine | 273/144 B |

FOREIGN PATENT DOCUMENTS

| | | | |
|---|---|---|---|
| 24366 | 12/1950 | Finland | 273/144 B |
| 1145504 | 5/1957 | France | 273/145 C |
| 2366854 | 6/1978 | France | 273/144 B |
| 7500129 | 7/1976 | Netherlands | 273/144 B |
| 284626 | 12/1952 | Switzerland | 273/144 B |

*Primary Examiner*—Paul E. Shapiro

*Attorney, Agent, or Firm*—David A. Jackson; Daniel H. Bobis

[57] ABSTRACT

A device for randomly selecting numbers, having particular utility with respect to state run lottery games, comprises a substantially square base including an upper surface having a first group with 40 recessed sections, a second group with 36 recessed sections, and third through sixth groups each with 10 recessed sections; four supports at the four corners on the underside of the base for imparting energy to the balls when the device is dropped onto a surface and for supporting the base; 16 balls, 6 of which are engageable within any of the recessed sections of the first group, six of which are engageable within any of the recessed sections of the second group, and the remaining four of which are engageable within any of the recessed sections of the third through sixth groups, respectively; at least one divider integrally formed with the upper surface of the base for preventing each ball associated with one of the groups from associating with the recessed sections of any other one of the groups; a transparent cover for covering the base; and a plurality of numbers, each positioned on the cover above a respective one of the recessed sections for identifying the latter.

10 Claims, 3 Drawing Figures

DEVICE FOR RANDOMLY SELECTING NUMBERS

BACKGROUND OF THE INVENTION

This invention relates generally to a device for randomly selecting numbers and, more particularly, is directed to a device for randomly selecting numbers having particular utility with respect to state run lottery games.

In the last few years, many states have developed lottery games to generate revenue. Various forms of these lottery games have been developed. For example, in one form, the player randomly selects six numbers out of a possible 36 or a possible 40 numbers and, if the six numbers selected by that player match the six numbers randomly selected by the state, the players wins. In other versions, the player must pick three numbers in the range from 000 to 999 or four numbers in the range from 0000 to 9999. Again, if the numbers selected by the player match the numbers randomly selected by the state, the player wins.

The following U.S. Patents relating to games in which balls fall within various recessed sections on a game board and which are known to the applicant are U.S. Pat. Nos. 570,858, and 479,432, and U.S. Pat. Nos. De. 151,231 and 140,075. These patents are not directed to a device for randomly selecting numbers in a state run lottery game.

OBJECTS AND SUMMARY OF THE INVENTION

Accordingly, it is an object of this invention to provide a device for randomly selecting numbers, having particular utility with respect to state run lottery games.

More particularly, it is an object of this invention to provide a device for randomly selecting numbers with respect to any of a plurality of different types of state run lottery games.

In accordance with an aspect of this invention, a device for randomly selecting numbers comprises a base including an upper surface with a plurality of adjacent groups of recessed sections, the number of recessed sections being different for at least two of the groups; a plurality of balls, each associated with a respective one of the groups and each engageable with any one of the recessed sections of the respective one of the groups; at least one divider for preventing each ball associated with one of the groups from associating with the recessed section of any one of the other groups; a cover for covering the base, at least a portion of the cover positioned above the recessed sections being transparent; and a plurality of numerical indicia corresponding to the numbers to be randomly selected, each position on one of the base and the cover in the proximity of a respective one of the recessed sections for identifying the respective one of the recessed sections.

In accordance with another aspect of this invention, a device for randomly selecting numbers comprises a base including an upper surface having a first group with 40 recessed sections, a second group with 36 recessed sections, and third, fourth, fifth and sixth groups each with ten recessed sections; a plurality of supports for supporting the base; 16 balls, 6 of which are engageable with any of the recessed sections of the first group, 6 of which are engageable within any of the recessed sections of the second group, and the remaining 4 of which are engageable with any of the recessed sections of the third, fourth, fifth and sixth groups, respectively; at least one divider for preventing each ball associated with one of the groups from associating with the recessed section of any other one of the groups; a cover for covering the base, at least a portion of the cover positioned above each recessed section being transparent; and a plurality of numerical indicia corresponding to the numbers to be randomly selected, each positioned on one of the base and the cover in the proximity of a respective one of the recessed sections for identifying the respective one of the recessed sections, the plurality of numerical indicia including numbers 1 through 40 associated with the recessed sections of the first group, numbers 1 through 36 associated the recessed sections of the second group, and four sets of numbers 0 through 9, each set associated with the recessed section of a respective one of the third through sixth groups, respectively.

The above, and other, objects, features and advantages of the present invention will become readily apparent from the detailed description thereof which is to be read in conjunction with the accompanying drawings.

DETAILED DESCRIPTION OF A PREFERRED EMBODIMENT

Figure 1:
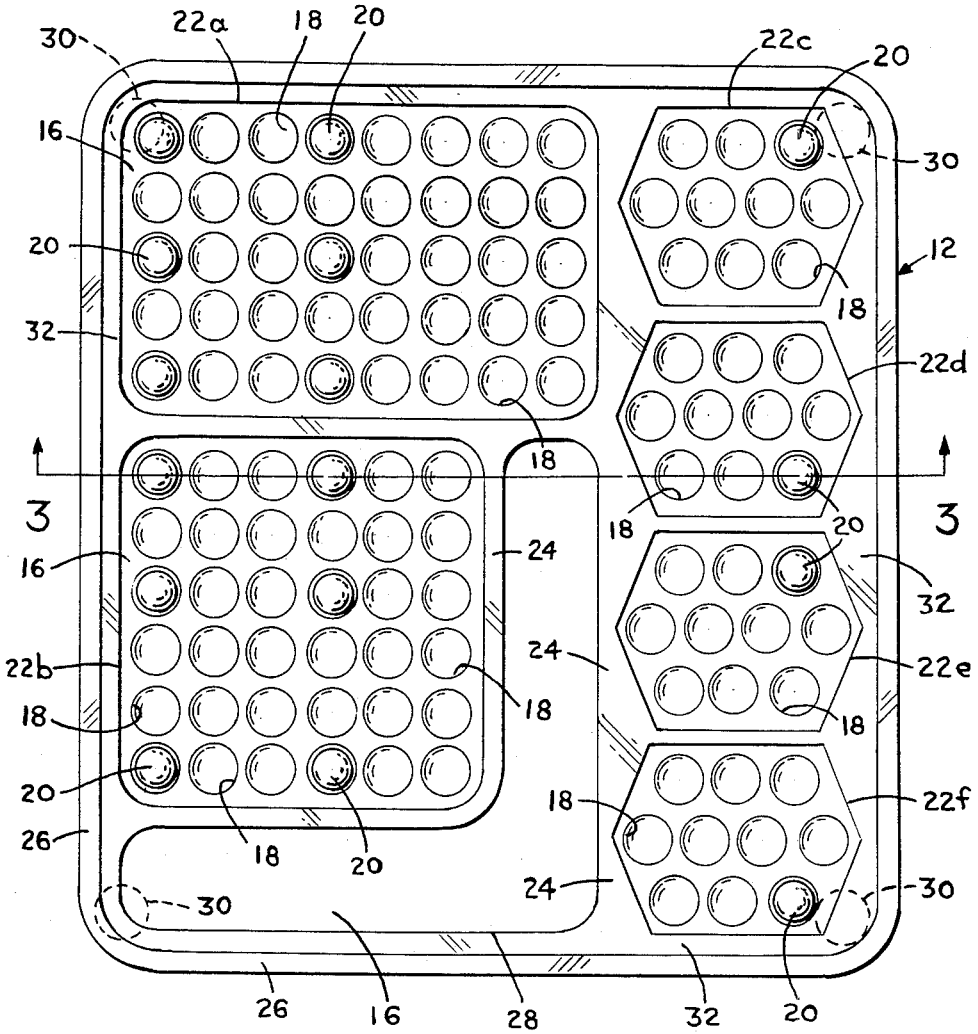
FIG. 1 is a top plan view of the base of the device for randomly selecting numbers according to one embodiment of the present invention.
Figure 2:
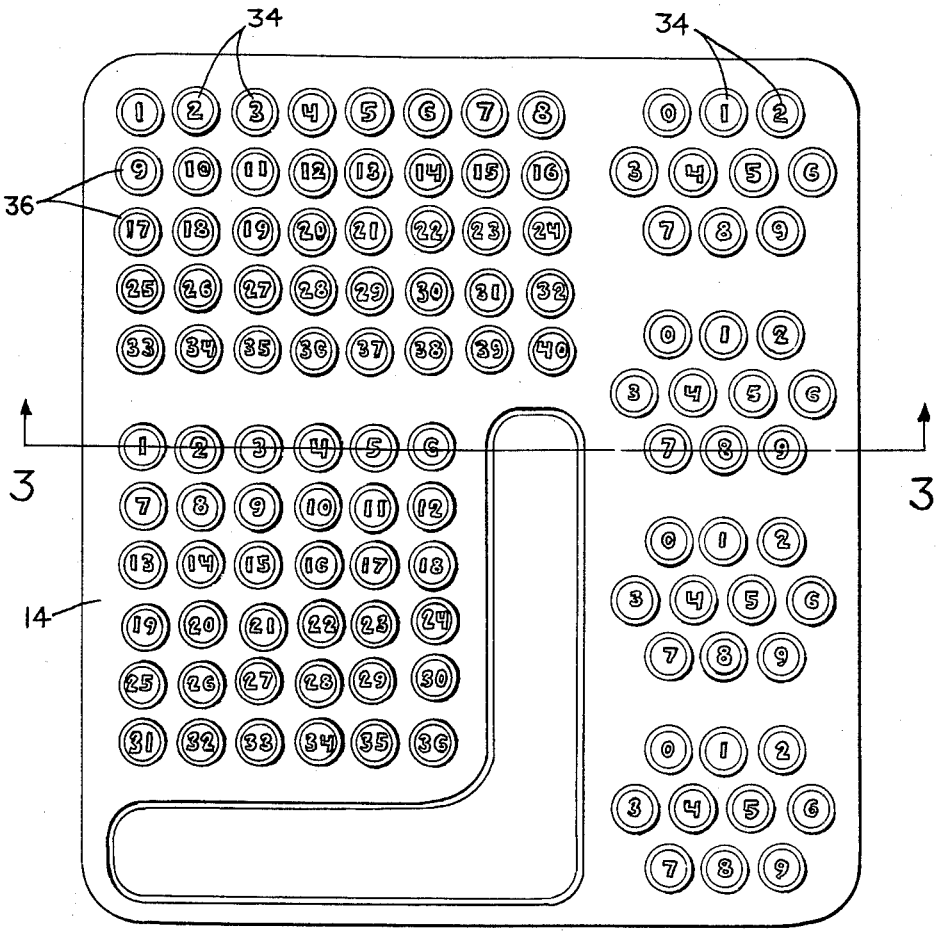
FIG. 2 is a top plan view of the cover of the device for randomly selecting numbers according to the present invention.
Figure 3:
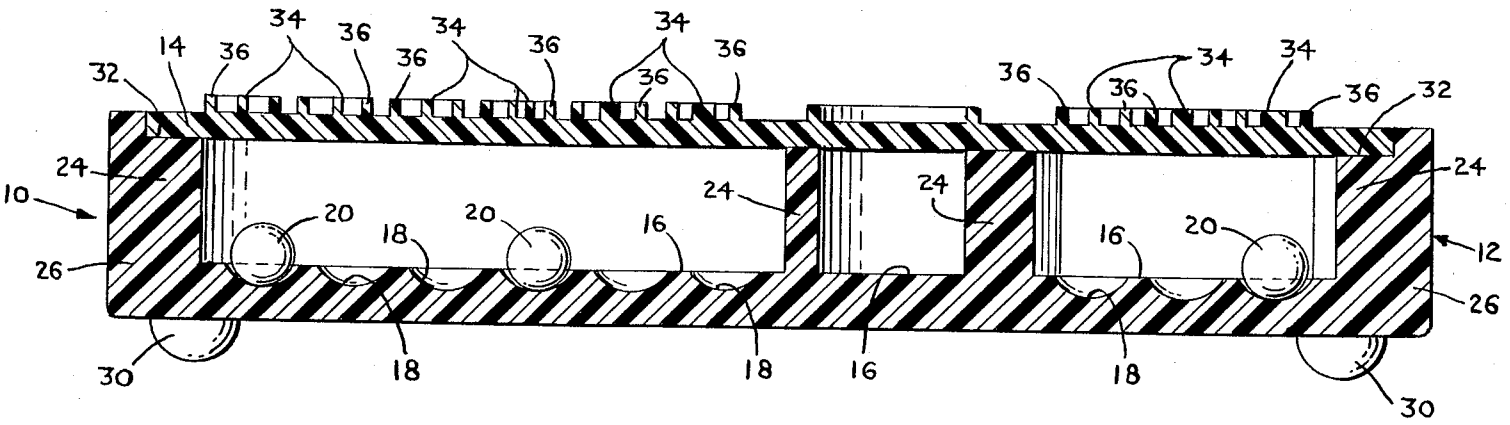
FIG. 3 is a cross-sectional view of the assembled base and cover of the device for randomly selecting numbers according to one embodiment of the present invention, taken along lines 3—3 of FIGS. 1 and 2.

Referring to the drawings in detail, a device 10 for randomly selecting numbers according to one embodiment of the present invention includes a base 12 shown in FIGS. 1 and 3 and a cover 14 shown in FIGS. 2 and 3. More particularly, base 12 includes a flat upper surface 16 having a plurality of circular recessed sections or cavities 18 within each of which a ball 20 can rest.

The recessed sections 18 are formed in first through sixth groups 22*a*–22*f*. More particularly, first group 22*a* as illustrated may contain 40 recessed sections 18, arranged, for example, in a 8 by 5 matrix; second group 22*b* contains 36 recessed sections arranged in a 6 by 6 matrix; and third through sixth groups 22*c*–22*f* each contain 10 recessed sections so as to define a hexagonal configuration. The recessed sections 18 in each group are spaced from each other by a distance which is sufficiently small to prevent a ball from resting on the flat upper surface 16 of base 12 between any adjacent recessed sections 18 of that group.

Divider 24 surrounds each group 22*a*–22*f* to prevent balls in one group from entering any other group on the base. As illustrated, first and second groups 22*a* and 22*b* always have six balls apiece associated therewith, and each of third through sixth group 22*c*–22*f* has one ball associated therewith.

While particular groups and matrices of recessed sections are shown, the invention should not be limited thereto, as variations in numbers and geometric patterns of groups, and numbers of balls are considered to be included herein.

As shown in FIG. 3, divider 24 may be integrally formed with base 12 so as to reduce manufacturing complexity and corresponding cost. Alternately, divider 24 may be formed with cover 14, or may even be separate from base 12 and cover 14.

Divider 24 also forms an upstanding peripheral wall 26 which surrounds base 12. Also, as shown in FIGS. 1 and 3, a central L-shaped portion 28 is provided which does not contain any recessed section 18. L-shaped section 28 does not serve any purpose with respect to the selection of random numbers in accordance with the present invention and is only provided in order to save on material costs.

As shown in FIGS. 1 and 3, four supports or legs 30 are secured to the undersurface of base 12 at the corners thereof for supporting the device 10. When the device is positioned on a horizontal surface and supported by legs 30, the flat upper surface 16 is horizontal to the surface on which the device 10 is supported.

As shown in FIG. 3, the upper end of peripheral wall 26 is cut away to define an inwardly directed shoulder 32 for supporting cover 14.

In this regard, cover 14 is formed as a thin, flat piece of plastic or other similar material having peripheral dimensions which match the dimensions of shoulder 32. As shown in FIG. 3, the internal portion of divider 24 is of a height sufficient to just meet the lower surface of cover 14 when the latter is secured with base 12. In this manner, as previously discussed, the balls 20 associated with each group 22*a*–22*f* cannot enter into any other group. Further, it will be appreciated from FIG. 3 that the height of divider 24 and shoulder 32 from the flat upper surface 16 of base 12 provides a sufficient distance for the balls 20 in each group to leave one recessed section therein and enter into any other recessed section therein.

Cover 14 may be secured to base 12 by any suitable means, such as adhesive or the like, that is, an adhesive between cover 14 and shoulder 32. Alternately, cover 14 may be ultrasonically welded into position, and in such event may be bonded along its edge abuttment with shoulder 32, and at the points of contact between the lower or under surface of the cover and the upper edge of divider 24. In this way, cover 14 will lend greater support to base 12, while base 12 correspondingly will steady cover 14 and eliminate its unwanted vibration during the use of the device.

Cover 14 is prepared from a material that is generally transparent or clear so that in the area of the numbered windows the player can readily detect the recess within which each ball 20 has come to rest. However, it is only necessary that that portion of cover 14 positioned above the recessed sections 18 and in the area of the reversed "L" be transparent, and all other areas of cover 14 may, for example, be translucent.

In accordance with the present invention, a plurality of numerical indicia 34 are provided in association with the recessed sections. More particularly, as shown in FIG. 2, numerical indicia 34 associated with first group 22*a* includes numbers 1 through 40 associated with the recessed sections thereof, numerical indicia 34 associated with second group 22*b* includes numbers 1 through 36 associated with the recessed sections thereof, and numerical indicia 34 associated with each of the third through sixth groups includes numbers 0 through 9 associated with the recessed sections of each respective group.

In accordance with one embodiment of the present invention, the numerical indicia 34 may be positioned as raised transparent numbers on the upper surface or cover 14 such that when cover 14 is assembled with base 12, each number is positioned above a respective recessed section 18. A raised circular section 36 may be formed in surrounding relation to each number 34 and may be colored so as to highlight the respective number with which it is associated.

It is to be appreciated, however, that the numerical indicia 34 may alternatively be positioned on base 12, for example, adjacent each recessed section 18, or preferably by hot stamping of the indicia to the lower surface of cover 14 within the location of circular section 36 or, if circular section 36 is also hot stamped thereon, in position to lie in registry with recessed sections 18. It is only important that the numerical indicia be positioned in the proximity of the recessed section for identifying the latter when the balls 20 are positioned therein.

The balls 20 may be fabricated from a variety of materials capable of offering lively response during the operation of the device, and may, for example, be prepared from hard plastic, plastic-coated steel or dense rubber. The invention is not limited to the particular material chosen.

In a preferred embodiment, the device may be fabricated with the base 12 molded from white plastic, the cover 14 molded with a generally translucent surface, having transparent portions in alignment with the recessed sections 18. The indicia may be hot stamped on the lower surface of cover 14 in white lettering and the balls 20 may be black, to offer sharp visual contrast for the player. Naturally, the foregoing color scheme is exemplary only and may vary within the scope of the invention.

In operation, the player may drop the device 10 onto a hard, flat horizontal surface from a distance of, for example, one-half inch or less. The four legs 30 will absorb the shock and impart this energy to the balls 20 with a lively action, thereby causing balls 20 to jump, bump, roll, mix and scatter until the energy is expended, whereby balls 20 come to rest in random order in respective ones of the recessed sections 18. In those states that have state run lottery games where a player must pick 6 numbers from a selection of 40 numbers, group 22*a* is used. In those states that have state run lottery games where a player must pick 6 numbers from a possible 36 numbers, the 36 recess group 22*b* is used. For state run lottery games where a player must pick 3 numbers in the range 000 to 999, three of the groups 22*c*–22*f* are used. For state run lottery games where a player must pick four numbers in the range from 0000 to 9999, all four groups 22*c*–22*f* are used. In the manner, the device 10 according to the present invention can be used to randomly select numbers for such state run lottery games.

It is to be appreciated that, in order to use the device 10 according to the present invention, it is not required that the device be dropped onto a hard, flat horizontal surface. For example, the player may operate the device by merely shaking it and then returning the device to a horizontal position.

It is to be further appreciated that the present invention may be used to select random numbers other than in state run lottery games. For example, the present invention can be utilized to play the game of roulette. This is accomplished by using the 36 cavity group 22*b*, with one of the six balls therein being a different color. Thus, if the different colored ball lands on an even numbered recessed section 18, black is selected and if it lands on an odd numbered recessed station 18, red is selected. Double zero could be selected by the zero numbered recess section 18 in two of the four 10 cavity groups 22*c*–22*f*.

Having described a specific preferred embodiment of the invention with reference to the accompanying drawings, it is to be understood that the present invention is not limited to this precise embodiment and that various changes and modifications may be effected therein by one of ordinary skill in the art within the scope and spirit of the present invention as defined by the appended claims.

What is claimed is:

1. A device for randomly selecting numbers, comprising:

a base including an upper surface with a plurality of adjacent groups of recessed sections, the number of recessed sections being different for at least two of said groups;

a plurality of balls, each associated with a respective one of said groups and each engageable with any one of said recessed sections of said respective one of said groups;

at least one divider for preventing each ball associated with one of said groups from associating with the recessed sections of any other one of said groups;

a cover for covering said base, at least a portion of said cover positioned above said recessed section being transparent;

a plurality of numerical indicia corresponding to said numbers to be randomly selected, each positioned on one of said base or said cover in the proximity of a respective one of said recessed sections for identifying said respective one of said recessed sections; and ball action enlivening means including a plurality of spaced supports secured to said base for imparting energy to said balls when said device is dropped onto a surface to cause the balls to move with greater randomness.

2. A device according to claim 1 in which said upper surface has a first group with 40 recessed sections, a second with 36 recessed sections, and third, fourth, fifth and sixth groups each with 10 recessed sections.

3. A device according to claim 2; in which the recessed sections in said first group are formed in a rectangular configuration, the recessed sections in said second group are formed in a square configuration and the recessed sections of each of said third through sixth are formed in a hexagonal configuration.

4. A device according to claim 2; in which there are 16 balls, 6 of which are engageable within any of the recessed sections of the first group, 6 of which are engageable within any of the recessed sections of the second group, and the remaining four of which are engageable with any of the recessed sections of the third through sixth groups, respectively.

5. A device according to claim 4; in which said plurality of numerical indicia includes numbers 1 through 40 associated with the recessed sections of the first group, numbers 1 through 36 associated with the recessed section of the second group, and four sets of numbers 0 through 9, each set associated with the recessed sections of a respective one of the third through sixth group, respectively.

6. A device accordingly to claim 1; in which all of said cover is transparent.

7. A device for randomly selecting numbers, comprising:

a base including an upper surface with a plurality of adjacent groups of recessed sections, the number of recessed sections being different for at least two of said groups, said upper surface having a first group with 40 recessed sections, a second group with 36 recessed sections, and third, fourth, fifth and sixth groups each with 10 recessed sections;

a plurality of 16 balls, each associated with a respective one of said groups and each engageable with any one of said recessed sections of said respective one of said groups, 6 of which are engageable within any of the recessed sections of the first group, 6 of which are engageable within any of the recessed sections of the second group, and the remaining four of which are engageable with any of the recessed sections of the third through sixth groups, respectively;

at least one divider for preventing each ball associated with one of said groups from associating with the recessed sections of any other one of said groups;

a cover for covering said base, at least a portion of said cover positioned above said recessed section being transparent; and a plurality of numerical indicia corresponding to said numbers to be randomly selected, each positioned on said cover in the proximity of a respective one of said recessed sections for identifying said respective one of said recessed sections, said plurality of numerical indicia including numbers 1 through 40 associated with the recessed sections of the first group, numbers 1 through 36 associated with the recessed section of the second group, and four sets of numbers 0 through 9, each set associated with the recessed sections of a respective one of the third through sixth group, respectively, each of said numerical indicia being formed as a raised transparent number on said cover and positioned above a respective one of said recessed sections.

8. A device for randomly selecting numbers, comprising:

a base including an upper surface having a first group with forty recessed sections, a second group with 36 recessed sections, and third, fourth, fifth and sixth groups each with 10 recessed sections;

a plurality of supports for supporting said base;

16 balls, 6 of which are engageable within any of the recessed sections of said first group, 6 of which are engageable within any of the recessed sections of said second group, and the remaining 4 of which are engageable within any of the recessed sections of said third, fourth, fifth and sixth groups, respectively;

at least one divider for preventing each ball associated with one of the groups from associating with the recessed sections of any other one of the groups;

a cover for covering said base, at least a portion of said cover positioned above each recessed section being transparent; and a plurality of numerical indicia corresponding to said numbers to be randomly selected, each positioned on said cover in the proximity of a respective one of said recessed sections for identifying said respective one of said recessed sections, said plurality of numerical indicia including numbers 1 through 40 associated with said recessed sections of said first group, numbers 1 through 36 associated with said recessed sections of said second group, and four sets of numbers 0 through 9, each set associated with said recessed sections of a respective one of said third through sixth groups, respectively, and each of said numerical indicia formed as a raised transparent number on said cover above a respective one of said recessed sections.

9. A device according to claim 8; in which all of said cover is transparent.

10. A device for randomly selecting numbers, comprising:

a base including an upper surface with a plurality of adjacent groups of recessed sections, the number of recessed sections being different for at least two of said groups;

a plurality of balls, each associated with a respective one of said groups and each engageable with any one of said recessed sections of said respective one of said groups;

at least one divider for preventing each ball associated with one of said groups from associating with the recessed sections of any other one of said groups;

a cover for covering said base, at least a portion of said cover positioned above said recessed section being transparent; and a plurality of transparent numerical indicia corresponding to said numbers to be randomly selected, each positioned on said cover in the proximity of a respective one of said recessed sections for identifying said respective one of said recessed sections.

* * * * *